US011478097B2

(12) United States Patent
Curci

(10) Patent No.: US 11,478,097 B2
(45) Date of Patent: Oct. 25, 2022

(54) COLLAPSIBLE HANGER COVER

(71) Applicant: Brian Curci, Freehold, NJ (US)

(72) Inventor: Brian Curci, Freehold, NJ (US)

( * ) Notice: Subject to any disclaimer, the term of this patent is extended or adjusted under 35 U.S.C. 154(b) by 307 days.

(21) Appl. No.: 16/562,615

(22) Filed: Sep. 6, 2019

(65) Prior Publication Data

US 2020/0077825 A1 Mar. 12, 2020

Related U.S. Application Data

(60) Provisional application No. 62/728,344, filed on Sep. 7, 2018.

(51) Int. Cl.
*A47G 25/40* (2006.01)
*A47G 25/20* (2006.01)

(52) U.S. Cl.
CPC ..... *A47G 25/4023* (2013.01); *A47G 25/20* (2013.01)

(58) Field of Classification Search
CPC .... A14G 25/4023; A47G 25/20; A47G 25/40; A47G 25/4015; A47G 25/4061; A47G 25/14; A47G 25/26; A47G 25/442; A47G 25/36
USPC ..... D6/315, 318, 319, 324, 328
See application file for complete search history.

(56) References Cited

U.S. PATENT DOCUMENTS 586,456 A 7/1897 Rideout
1,268,416 A * 6/1918 Wordingham ..... A47G 25/36 223/98
1,547,951 A * 7/1925 Olson ..... A47G 25/20 223/88
1,570,196 A * 1/1926 Barron ..... A47G 25/4061 223/89
2,210,344 A 8/1940 Abraham
2,348,523 A * 5/1944 Chaikin ..... A47G 25/20 223/98
2,353,839 A * 7/1944 McFall ..... A47G 25/26 223/98
2,434,461 A * 1/1948 Forcheimer ..... A47G 25/26 223/98
2,544,170 A * 3/1951 Mills ..... A47G 25/4023 223/89
2,581,631 A * 1/1952 Carta ..... A47G 25/26 223/98
2,605,942 A * 8/1952 Warren ..... A47G 25/4023 223/89
2,675,948 A * 4/1954 Mallory ..... A47G 25/26 223/98
2,884,171 A 4/1959 Knuth
3,762,614 A * 10/1973 Musante ..... A47G 25/1407 223/98
4,632,287 A * 12/1986 Bevelander ..... A47G 25/20 223/98
4,813,581 A 3/1989 LaMont
D309,834 S * 8/1990 Passini ..... D6/318
4,988,021 A 1/1991 Adams et al.
5,383,584 A 1/1995 Adams
5,590,823 A 1/1997 Lunde
(Continued)

*Primary Examiner* — Ismael Izaguirre
(74) *Attorney, Agent, or Firm* — Wei & Sleman LLP

(57) ABSTRACT

A hanger cover extends between a first end and a second end. The hanger cover includes a pair of wings coupled together, each of the pair of wings having a pair of substantially parallel branches spaced apart by a channel and joined at a junction, wherein the pair of wings are rotatable relative to one another.

18 Claims, 11 Drawing Sheets

(56) References Cited

U.S. PATENT DOCUMENTS

| | | | | |
|---|---|---|---|---|
| 5,893,493 | A * | 4/1999 | Noiray | A47G 25/4061 223/94 |
| 6,964,360 | B2 * | 11/2005 | Tubman | A47G 25/442 223/89 |
| 7,172,102 | B2 * | 2/2007 | Lewien | A47G 25/4023 223/89 |
| 9,801,485 | B2 * | 10/2017 | Snow | A47G 25/32 |
| D806,409 | S * | 1/2018 | Schapiro | D6/328 |
| 2005/0184110 | A1 * | 8/2005 | Berglund | A47G 25/20 223/98 |
| 2005/0252938 | A1 * | 11/2005 | Schapiro | A47G 25/20 223/85 |
| 2009/0127298 | A1 | 5/2009 | Sprovieri | |
| 2010/0059557 | A1 | 3/2010 | Temali et al. | |
| 2011/0121041 | A1 | 5/2011 | Tukulj-Popovic | |
| 2011/0284597 | A1 | 11/2011 | Kaleta et al. | |
| 2020/0077825 | A1 * | 3/2020 | Curci | A47G 25/4023 |

* cited by examiner

COLLAPSIBLE HANGER COVER

FIELD OF THE DISCLOSURE

The present disclosure relates to devices and methods for hanging articles of clothing. More particularly the present disclosure relates to collapsible hanger covers for use with standard hangers.

BACKGROUND OF THE DISCLOSURE

Clothes hangers are used to suspend coat, shirts, jackets, sweaters, blouses, dresses and other clothing items to prevent wrinkles. Traditional hangers are formed of metallic wire or plastic. Metallic wire hangers are typically manufactured by shaping a metal wire into a generally triangular perimeter that includes an upper hook. Plastic hangers are generally manufactured in a similar shape. Certain variations are possible, such as those that include extending arms, but do not include a lower arm.

Such hangers are ubiquitous due to their low-cost. Wire hangers and skinny plastic hangers can, however, deform the fabric being hung, and may even damage such items. This is especially true when the clothing item is wet or damp. In such cases, the garment may deform and the clothes hanger will "dig" in to the fabric, often causing irreparable damage to the fabric or garment.

SUMMARY OF THE DISCLOSURE

In at least some examples, a hanger cover extends between a first end and a second end. The hanger cover includes a pair of wings coupled together, each of the pair of wings having a pair of substantially parallel branches spaced apart by a channel and joined at a junction, wherein the pair of wings are rotatable relative to one another.

BRIEF DESCRIPTION OF THE DISCLOSURE

Various embodiments of the presently disclosed hanger covers are disclosed herein with reference to the drawings, wherein.

Figure 7A:
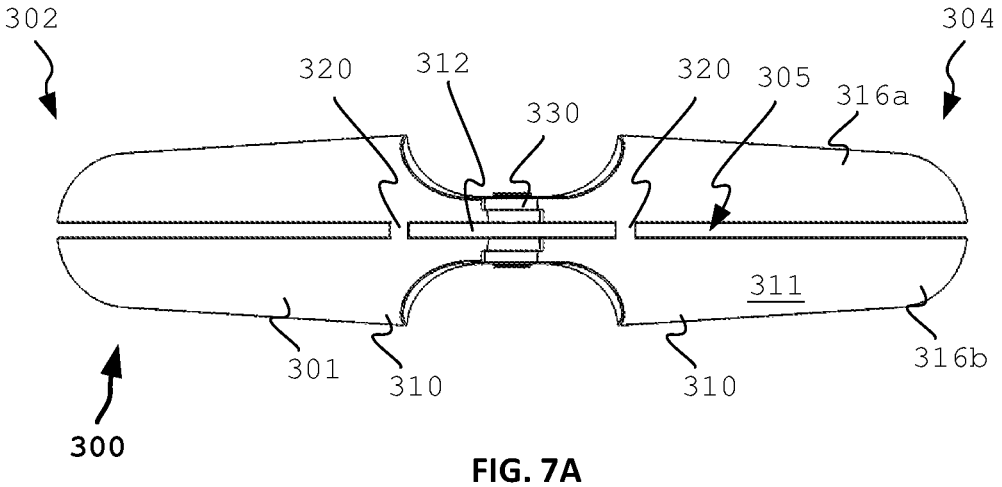
Figure 7B:
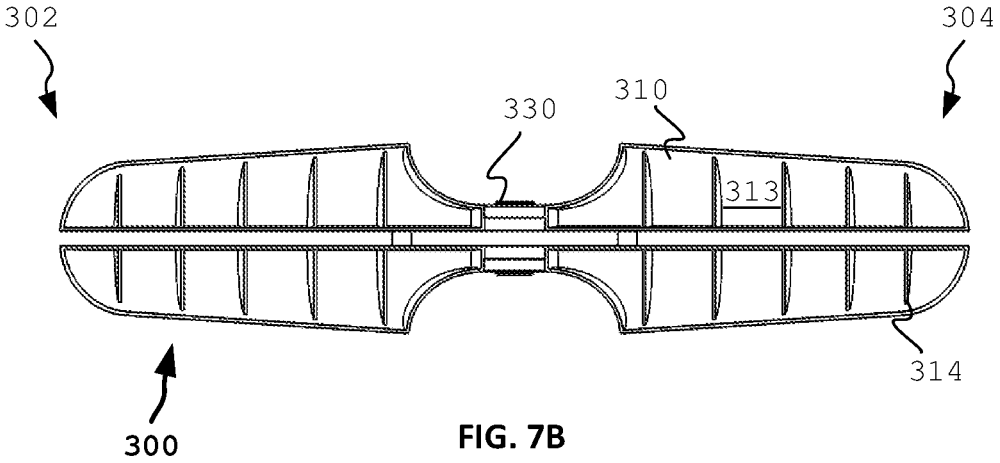
Figure 7C:
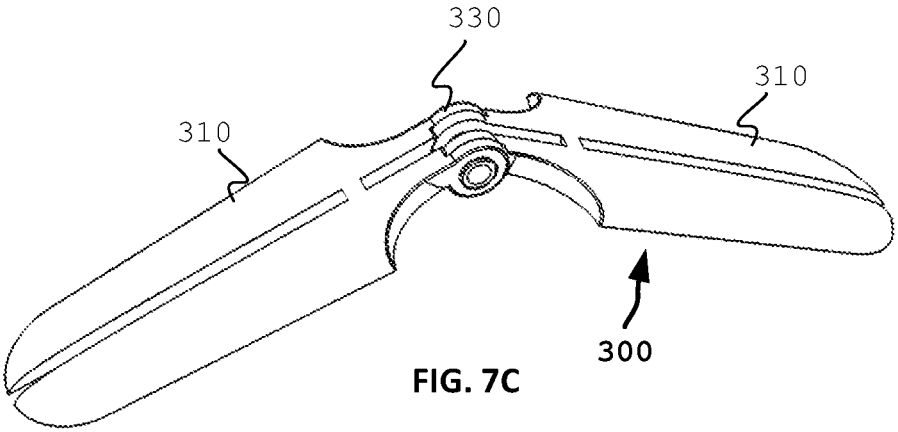
Figure 7D:
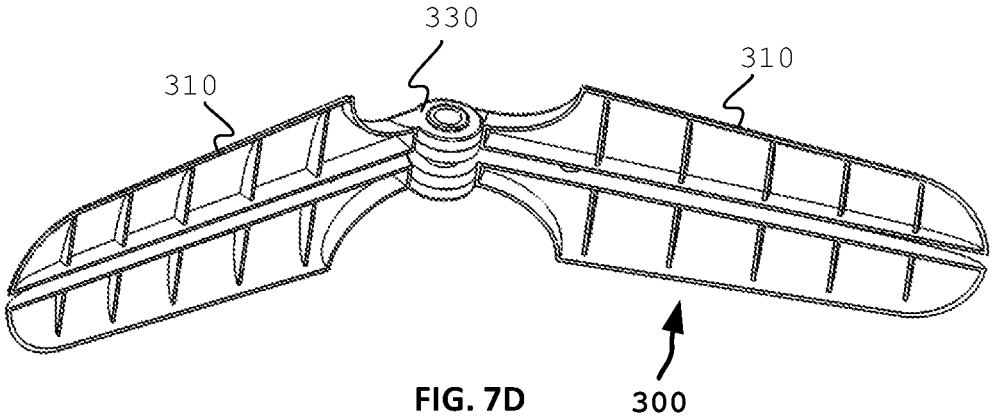
Figure 7E:
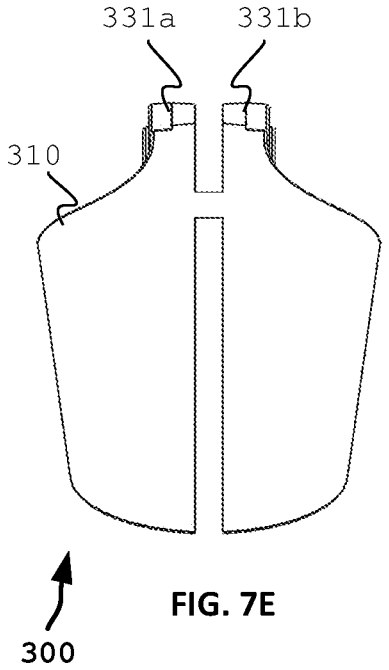
Figure 7F:
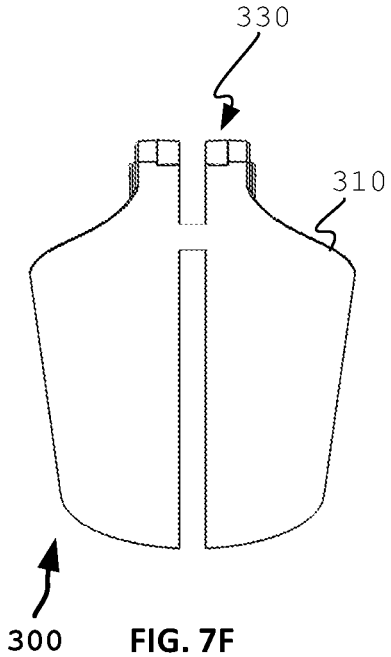
Figure 7G:
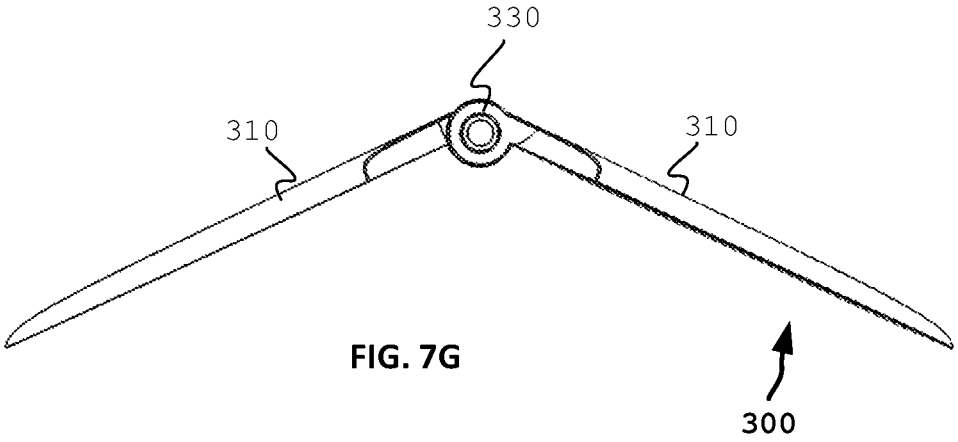
Figure 7H:
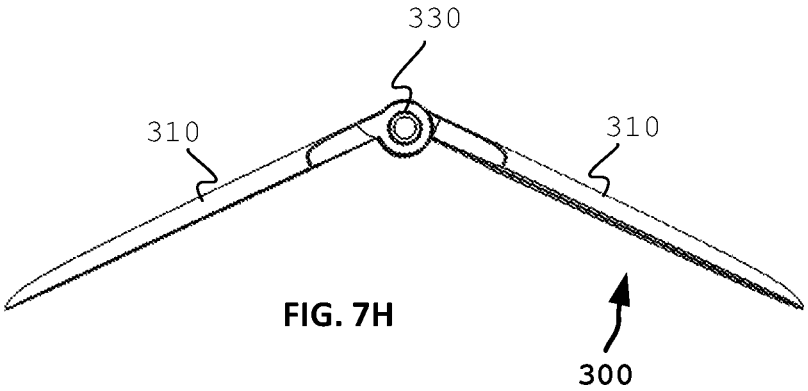
Figure 7I:
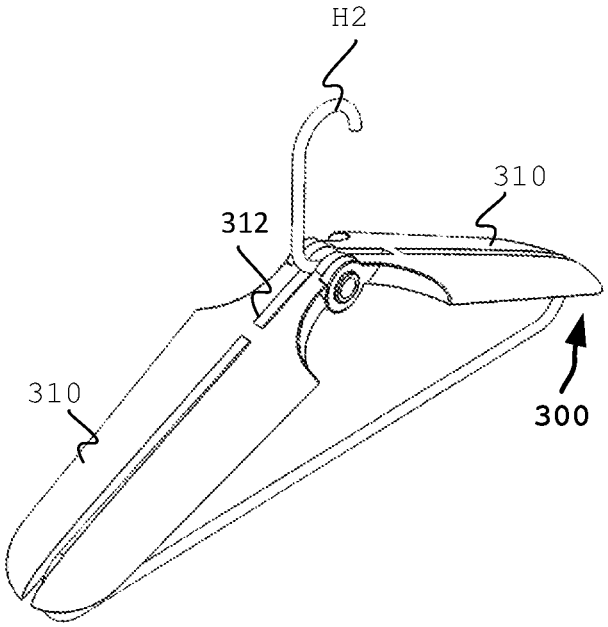
Figure 7J:
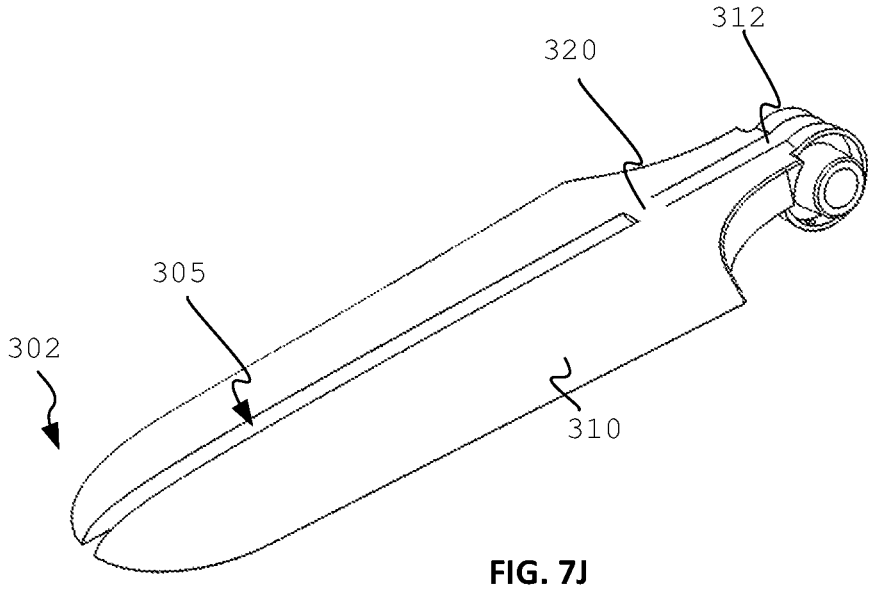
Figure 8A:
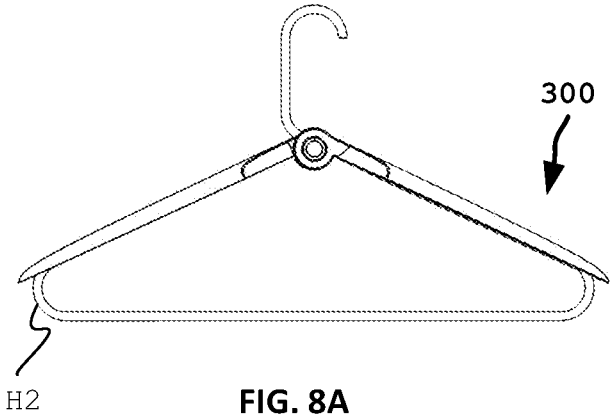
Figure 8B:
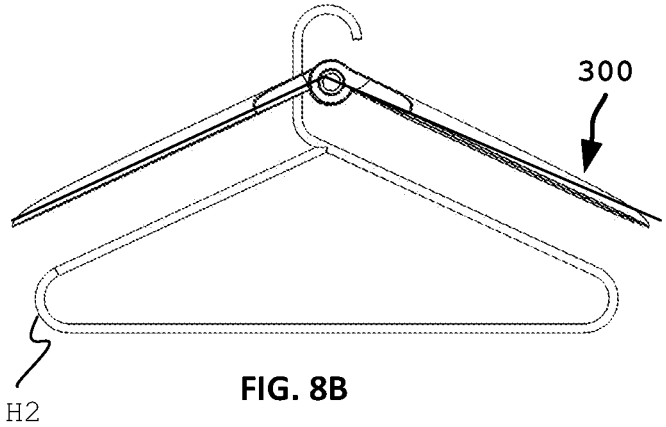
Figure 8C:
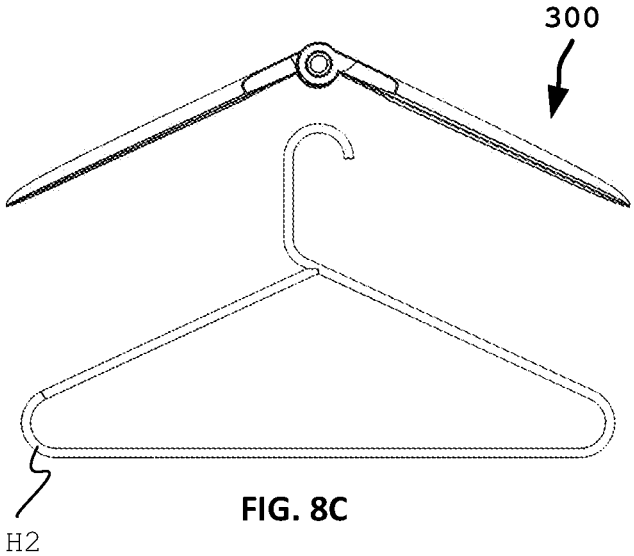
Figure 9A:
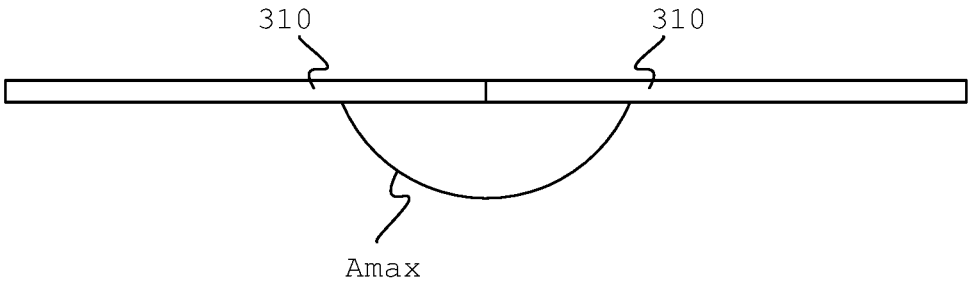
Figure 9B:
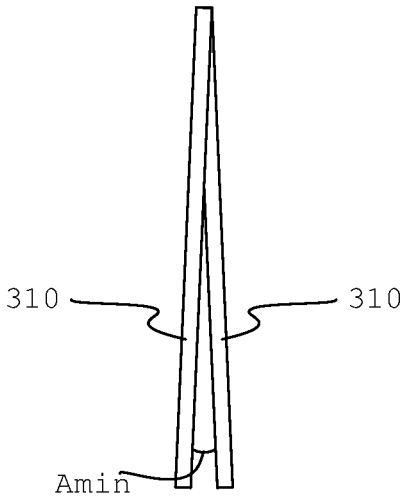

FIGS. 7A-I are schematic top, bottom, upper perspective, lower perspective, front, back, left side, right side, and assembled perspective views of another embodiment of a hanger cover;

FIG. 7J is a schematic perspective view of a single wing;

FIGS. 8A-C are schematic side views showing various stages of assembling a hanger cover on a hanger; and FIGS. 9A-B are schematic representations showing the range of motion of a hanger cover.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to clothes hangers, conventional devices and methods suffer from certain shortcomings such as those discussed above.

There therefore is a need for further improvements to the devices and methods used to hang apparel. Among other advantages, the present disclosure may address one or more of these needs.

Figure 1:
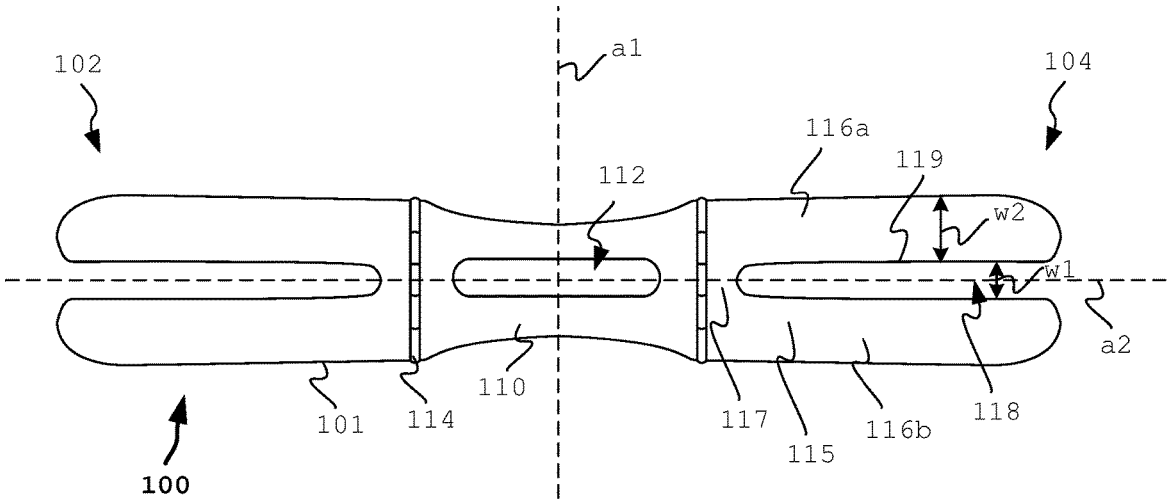
FIG. 1 is a schematic top view of the hanger cover according to one embodiment.

FIG. 1 is a schematic top view of a hanger cover 100 according to one embodiment of the disclosure. Hanger cover 100 generally includes a body 101 that extends between first end 102 and second end 104. Body 101 is formed of three main portions including central portion 110, and a pair of arms 115 disposed on each side of central portion 110 such that body 101 is symmetric about a first axis a1. Body 101 may be formed of any suitable material including metal, plastic, or wood. As shown, central portion 110 defines an elongated central aperture 112 configured and arranged to receive a hook of a traditional hanger. In some examples, the central aperture 112 is at least 3 inches or 4 inches in length. In some embodiments, the shape of central aperture 112 may be modified into an oval, circle, track-shaped, square or otherwise so long as the central aperture is sized to receive the hook of a hanger. Hinges 114 couple the central portion 110 to each of the arms 115. The specifics and actuation of hinge 114 will be discussed in more detail below, but it would suffice to explain that the configuration shown in FIG. 1 is that of a hanger cover with the arms in the expanded condition. Each of arms 115 may include first and second parallel branches 116*a*,116*b* joined together at a junction 117 and defining an elongated side opening 118 between the branches, the side opening 118 being large enough to receive a portion of a traditional hanger. In some examples, side opening 118 may have a width w1 of between 8 inches and 10 inches.

Additionally, each branch may have a width w2 of between 2 inches and 6 inches, such a width providing more surface area for contact with the fabric to reduce the stress on the fabric at, for example, the shoulder regions. As shown, each of the branches includes a flat edge 119 that runs substantially parallel with another flat edge of a corresponding branch. The same configuration may be present on an opposing end of the body with another arm having another pair of branches. As shown, branches 116 may be similar so that the body 101, in addition to being symmetric about axis a1, is also symmetric about a second axis a2.

Figure 2:
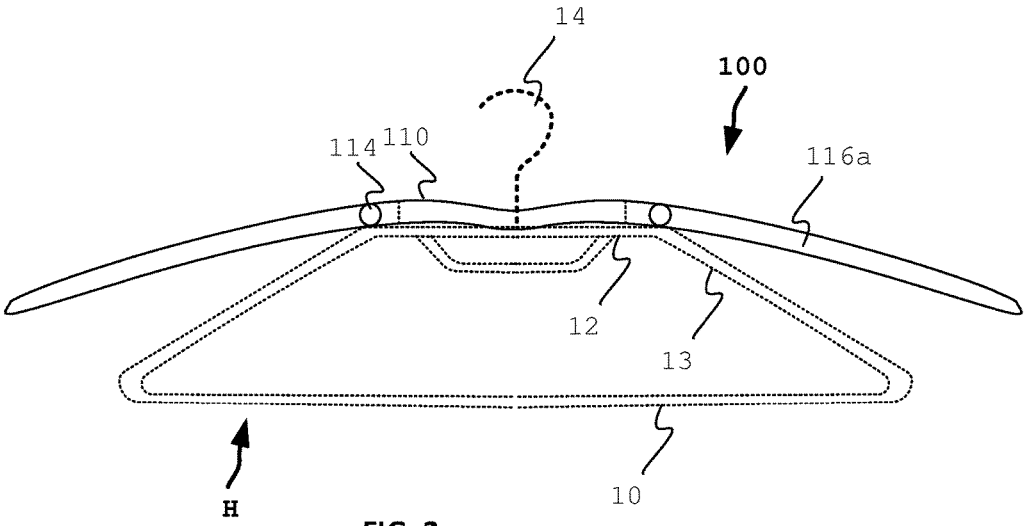
FIG. 2 is a schematic side view of the hanger cover of FIG. 1 in use with a traditional hanger.
Figure 3:
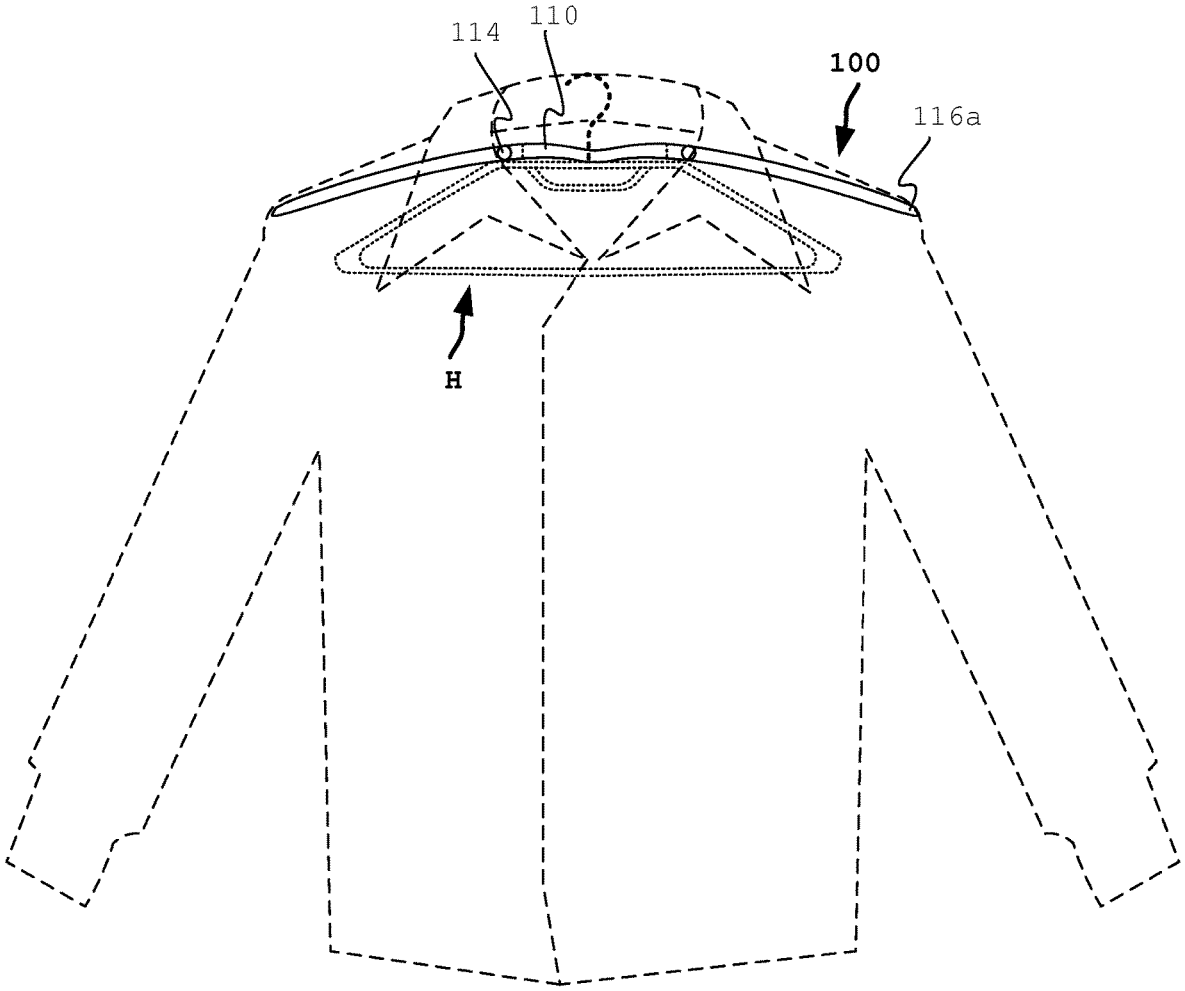
FIG. 3 is a schematic side view of the hanger cover of FIG. 1 being used to hang a dress shirt.

FIG. 2 is a schematic side view of the hanger cover 100 of FIG. 1 in use with a traditional hanger "H". Hanger "H" may generally have a trapezoidal shape including a lower bar 10, an upper bar 12 and side bars 13. Hanger "H" also includes a hook 14 coupled to upper bar 12. As shown, hinges 114 of hanger cover 100 may rest on upper bar 12 or side bars 13, and hook 14 may pass through central aperture 112 of central portion 110 of hanger cover 100. The widened branches 116 or arms 115 provide a sufficient area so that the shoulder portions of a dress shirt may gently rest on the branches without being deformed (FIG. 3). This may be especially helpful when hanging a damp or wet garment. In such instances, deformed shoulder bumps are formed in a dress shirt due to narrow portions of the traditional hanger pressing against the fabric. Hanger cover 100 solves this problem by providing a larger surface area for contacting the shirt or garment, reducing the risk of deformation.

Figure 4:
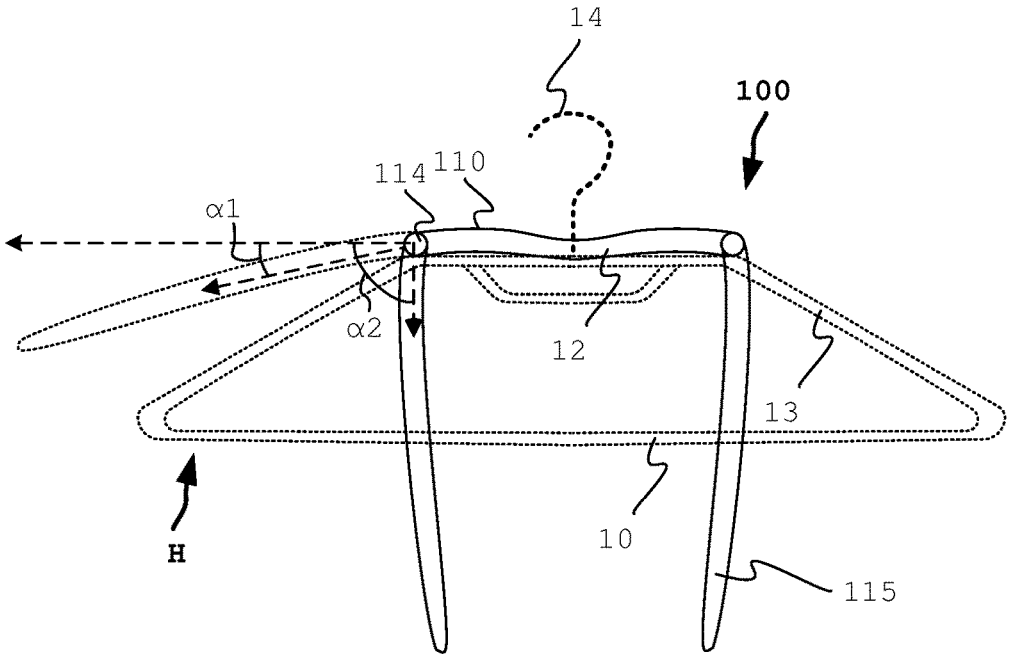
FIG. 4 is a schematic side view of the hanger cover of FIG. 1 in use with a traditional hanger, after the arms of the hanger cover have been collapsed.
Figure 5:
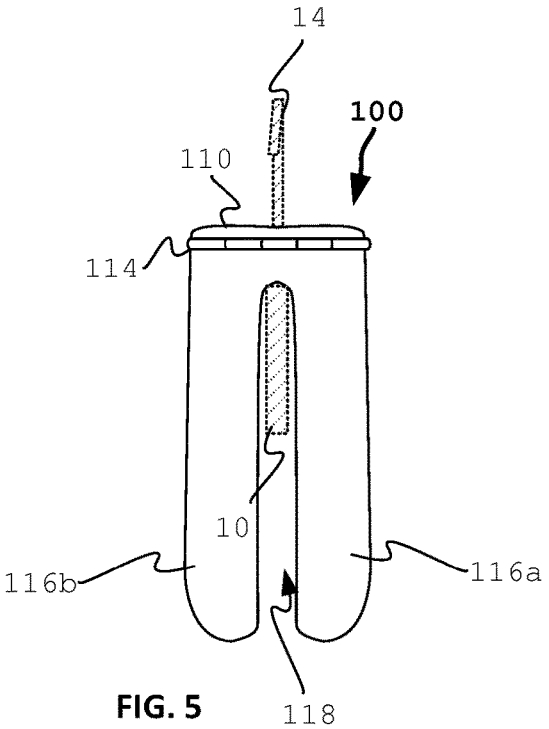
FIG. 5 is a schematic front view of the hanger cover of FIG. 1 being disposed over a traditional hanger.

When not in use, arms 115 of hanger cover 100 may be collapsed as shown in FIG. 4. Specifically, in some examples, hinges 114 may be partially or fully metallic butt hinges, or other suitable hinge that allows for expansion or collapsing of the arms 115 with respect to the central portion 110. As shown, hinge 114 may allow for the arms 115 to actuate between an expanded configuration of a1 of between 0 and 30 degrees, and a collapsed configuration of a2 of between 60 and 110 degrees with respect to the longitudinal axis of the central portion. In some examples, the arms 115 may be substantially parallel with the central portion 110 in the expanded condition, and substantially orthogonal to the central portion 110 in the collapsed condition. When in the collapsed configuration, branches 116 of arms 115 fall on either side of hanger "H", with the hanger "H" being disposed within side opening 118. FIG. 5 is a schematic front view of the hanger cover of FIG. 1 being disposed over a traditional hanger "H".

Figure 6:
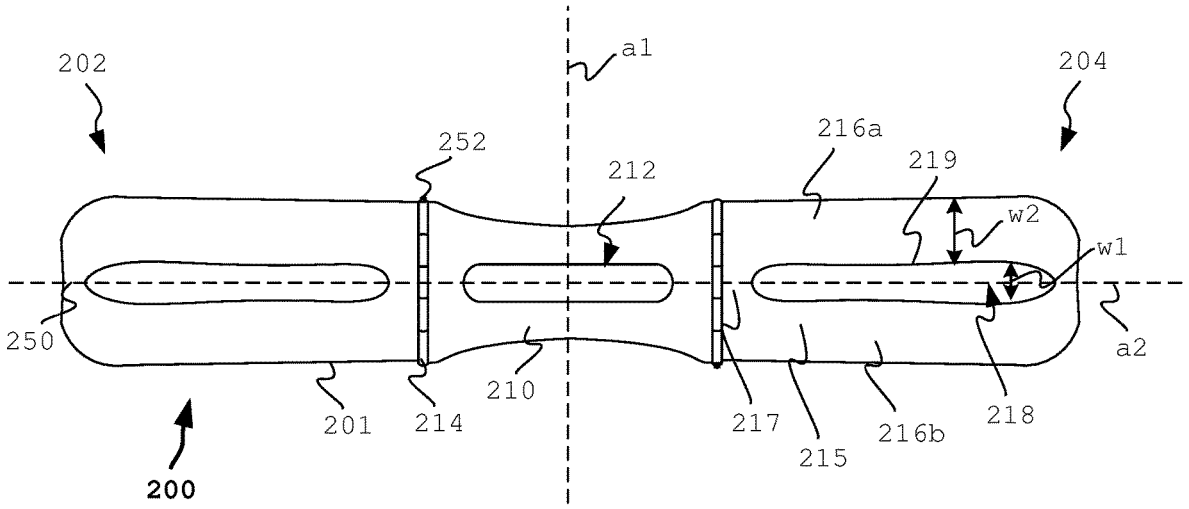
FIG. 6 is a schematic top view of the hanger cover according to another embodiment.

FIG. 6 illustrates yet another embodiment of a hanger cover. Hanger cover 200 of FIG. 6 is similar to that of FIG. 1, and like-numbered elements are shown except that they are preceded with a "2" instead of a "1". One major difference between the two configurations is that hanger cover 200 includes joining portions 250 that connect each of the two arms 216*a*,216*b*. With the two arms connected, a pair of closed side apertures 218 are formed instead of the side openings. By "closed" it is meant that the body of hanger covers forms a complete perimeter around the side apertures. Though the side apertures 218 are formed in somewhat irregular shape, it will be understood that they can be oval, circle, track-shaped, rectangular or any suitable shape capable of allowing portions of the hanger to pass therethrough. One additional difference between the configuration of FIG. 6 and FIG. 1 is the presence of locking pins 252 on hinges 214, the locking pins being capable of actuated (e.g., pushed, pulled, turned, etc.) to allow the arms of the hanger cover to transition between a locked condition in which the arms are incapable of rotation relative to the rest of the body, and an unlocked condition in which rotation is possible.

FIGS. 7A-I show several views of another embodiment of a hanger cover 300. Hanger cover 300 of FIGS. 7A-I is similar to that of FIG. 2 and is designed to protect damp or wet garments while drying. Hanger cover 300 generally includes a two-piece body 301 that is formed of two separable wings 310 that together extend between first end 302 and second end 304. Body 301 (i.e., each of wings 310) may be formed of any suitable material including metal, plastic, or wood and may have a smooth upper surface 311 having rounded edges and a striated lower surface 313 having a plurality of perpendicular joists 314 for reinforcing each of the wings and increasing rigidity in the wings.

As shown, the two wings 310 define an elongated central aperture 312 configured and arranged to receive a hook of a traditional hanger H2 as best shown in FIG. 71. In some examples, the central aperture 312 is at least 2 inches or 4 inches in length and more than ⅛ inch in width. The central aperture 312 is shown as being generally rectangular, although in some embodiments, the shape of central aperture 312 may be modified into an oval, circle, track-shaped, square or otherwise so long as the central aperture is sized to receive the hook of a hanger.

Each of wings 310 may include first and second parallel branches 316*a*,316*b* spaced apart by a generally uniform channel 305. Channel 305 may be as wide as central aperture 312. In at least some examples, channel 305 is between 1/16 and ¼ inch in width. Branches 316*a*,316*b* may be mirror images of one another and each branch may include a straight inner edge and a curved outer edge. Each branch may be progressively wider from a first end to a second end until it reaches a maximum position and then forms a scalloped portion adjacent the hinge. The two branches 316,316*b* may be joined together to form a wing via a cross brace 320 that extends perpendicular to the length of the wing, and being coupled to the two wings. In at least some examples, the two branches and the cross brace are unitarily formed.

Each wing 310 may terminate in a rounded head 330. As best seen in the front view of FIG. 7E, each head 330 may include a pair of parallel disks 331*a*,331*b* spaced apart from one another, and include a circular inner abutment 332, the head being configured and arranged to mate with and couple to a head of the other wing to collectively form a hinge. Specifically, the parallel disks 331*a*,331*b* of each two the two heads 330 may nest with one another so that a hinge is formed between the two heads allowing the two wings to rotate with respect to one another. The heads 330 may be formed so that the two are capable of coupling with on another and forming the hinge without occluding or blocking any portion of the central aperture 312.

FIGS. 8A-C are schematic side views showing various stages of assembling a hanger cover 300 on a hanger H2. Hanger cover 300 may slide on and off hanger H2 by vertically translating it and placing it over the hanger, and specifically by inserting the hook of hanger H2 through central aperture 312. In addition to the translation, the two wings of hanger cover 300 may be rotated with respect to one another so that the two wings form a maximum angle "Amax" of 180 degrees and minimum angle "Amin" 5 degrees as shown in the schematic representation of FIG. 9A-B. Thus, the hanger cover may transition between an expanded condition and a collapsed condition. Garments may be placed on the hanger cover in the expanded condition. When the garments have dried, and the user wishes to remove the hanger cover while keeping the garment on the hanger, the hanger cover may be collapsed and pulled through, for example, the neckline.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A hanger cover extending between a first end and a second end, the hanger cover comprising:

a pair of wings coupled together, each of the pair of wings having a pair of substantially parallel branches spaced apart by a channel and joined at a junction, wherein the pair of wings are rotatable relative to one another;

wherein each of the wings includes a head that forms a portion of a hinge.

2. The hanger cover of claim 1, further comprising a central aperture defined through the pair of wings.

3. The hanger cover of claim 1, wherein the channel is uniform.

4. The hanger cover of claim 1, wherein each of the branches includes a straight edge and an opposing curved edge.

5. The hanger cover of claim 2, wherein each of the branches includes a scalloped portion adjacent the central aperture.

6. The hanger cover of claim wherein each head includes a pair of parallel disks spaced apart from one another and configured to mate with an opposing head of an opposing wing.

7. The hanger cover of claim wherein each head includes a pair of parallel disks spaced apart from one another and configured to nest with an opposing head of an opposing wing.

8. The hanger cover of claim wherein the hinge is configured and arranged to provide a range of motion of between 180 and 5 degrees.

9. The hanger cover of claim 1, wherein each of the pair of wings includes a smooth upper surface.

10. The hanger cover of claim 1, wherein each of the pair of wings includes a lower surface having a number of joists.

11. The hanger cover of claim 1, wherein each of the wings includes a cross brace extended between two branches of the wing.

12. The hanger cover of claim 1, wherein each of the wings is formed of plastic.

13. A hanger cover extending between a first end and a second end, the hanger cover comprising:

a first wing having a first pair of substantially parallel first branches spaced apart by a first channel, the first branches being joined at a first junction, the first wing having a first head at one end;

a second wing having a second pair of substantially parallel second branches spaced apart by a second channel, the second branches being joined at a second junction, the second wing having a second head at one end, the first head and the second head being coupleable; and a central aperture defined through the first head and the second head.

14. The hanger cover of claim 13, wherein the first wing and the second wing are rotatable relative to one another.

15. The hanger cover of claim 13, wherein the first channel and the second channel are both uniform.

16. A hanger cover extending between a first end and a second end, the hanger cover comprising:

a first wing having a first pair of substantially parallel first branches spaced apart by a first channel, the first branches being joined at a first junction, the first wing having a first head at one end; and a second wing having a second pair of substantially parallel second branches spaced apart by a second channel, the second branches being joined at a second junction, the second wing having a second head at one end, the first head and the second head being coupleable, wherein the first head and the second head collectively form a hinge.

17. The hanger cover of claim 13, wherein the first head and the second head are configured to nest with one another.

18. The hanger cover of claim 13, wherein each of the first head and the second head includes a pair of parallel disks spaced apart from one another.

* * * * *